US012123279B2

(12) United States Patent
Hovda et al.

(10) Patent No.: US 12,123,279 B2
(45) Date of Patent: Oct. 22, 2024

(54) SETTING A CEMENT PLUG

(71) Applicant: CONOCOPHILLIPS COMPANY, Houston, TX (US)

(72) Inventors: Lars Hovda, Tananger (NO); Dan Mueller, Houston, TX (US); James C. Stevens, Houston, TX (US); Amal Phadke, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 165 days.

(21) Appl. No.: 17/407,021

(22) Filed: Aug. 19, 2021

(65) Prior Publication Data

US 2022/0056780 A1 Feb. 24, 2022

Related U.S. Application Data

(60) Provisional application No. 63/112,427, filed on Nov. 11, 2020, provisional application No. 63/112,448,
(Continued)

(51) Int. Cl.
*E21B 33/14* (2006.01)
*E21B 33/13* (2006.01)
(Continued)

(52) U.S. Cl.
CPC ..... *E21B 33/14* (2013.01); *E21B 33/13* (2013.01); *E21B 37/00* (2013.01); *E21B 41/0078* (2013.01)

(58) Field of Classification Search
CPC ..... E21B 33/00
See application file for complete search history.

(56) References Cited

U.S. PATENT DOCUMENTS 2,204,658 A * 6/1940 Burt ..... E21B 33/134 166/223
2,374,169 A 4/1945 Boynton
(Continued)

FOREIGN PATENT DOCUMENTS

GB 2325479 A 11/1998

OTHER PUBLICATIONS

International Search Report for PCT/US2021/046769 mailed Dec. 17, 2021; 4 pgs.
(Continued)

*Primary Examiner* — Angela M DiTrani Leff
*Assistant Examiner* — Avi T Skaist
(74) *Attorney, Agent, or Firm* — CONOCOPHILLIPS COMPANY

(57) ABSTRACT

The invention relates to a cementing tool (1) and method for setting a cement plug. Instead of the conventional "balanced plug", the technique involves pumping cement whilst pulling and rotating the tool. The cementing tool (1) includes nozzles (9) for jetting cement which are located in a relatively narrow region (8) of the tool and a larger diameter choke region (5) proximal of the nozzles (9). The end of the tool (11) is closed off and tapered. The tool is passed down the well to a location where it is desired to set a plug, then cement is injected whilst rotating and withdrawing the tool. The jets of cement help displace existing fluid in the well thereby reducing mixing of the existing fluid with the cement, The choke region (5) increases the flow energy, whilst the tapered end (11) helps prevent disruption to the cement as the tool is withdrawn. The choke region (5) may be expandable to allow the tool to pass through a cased part of the well and then set a plug in an under-reamed open hole part of the well.

16 Claims, 3 Drawing Sheets

Related U.S. Application Data filed on Nov. 11, 2020, provisional application No. 63/112,440, filed on Nov. 11, 2020, provisional application No. 63/067,599, filed on Aug. 19, 2020.

(51) Int. Cl.
*E21B 37/00* (2006.01)
*E21B 41/00* (2006.01)

(56) References Cited

U.S. PATENT DOCUMENTS 3,116,800 A * 1/1964 Kammerer ..... E21B 21/10 175/406
6,357,968 B1 * 3/2002 Dwyer ..... E02D 5/18 405/269
2010/0288562 A1 * 11/2010 Dove ..... F02M 61/162 123/299
2013/0248187 A1 * 9/2013 Al-Anazi ..... E21B 23/08 166/212
2020/0040707 A1 2/2020 Watts et al.

OTHER PUBLICATIONS

Ferg, T.—"Novel Techniques to More Effective Plug and Abandonment Cementing Techniques", 2011, Society of Petroleum Engineers Artic and Extreme Environments Conference, Moscow, SPE 148640; 13 pgs.
"Quality in Balance Plug Cementing Operations", 2019, 2019 Plug and Abandonment, ConocoPhillips Seminar in Stavanger, Norway; 22 pgs.
Hovda, Lars, et al—"Best Practice for Cementing and Zonal Isolation Using the Jet-Type Perforage, Wash and Cement Technique", 2020, Society of Petroleum Engineers, SPE 202397-MS; 46 pgs.
Phadke, Amal, et al—"Application of Computational Fluid Dynamics for Parametric Optimization of Jet-Type P/W/C Technique",. 2020, Society of Petroleum Engineers, SPE 202441-MS; 28 pgs.

* cited by examiner

SETTING A CEMENT PLUG

CROSS-REFERENCE TO RELATED APPLICATIONS

This application is a provisional application which claims benefit under 35 USC § 119(e) to U.S. Provisional Application Ser. No. 63/067,599 filed Aug. 19, 2020, entitled "Jet-Type Perforation-Wash-Cement Parameterization," U.S. Provisional Application Ser. No. 63/112,427 filed Nov. 11, 2020, entitled "Behind Casing Wash and Cement," U.S. Provisional Application Ser. No. 63/112,440 filed Nov. 11, 2020, entitled "Behind Casing Cementing Tool" and U.S. Provisional Application Ser. No. 63/112,448 filed Nov. 11, 2020, entitled "Setting a Cement Plug", each of which is incorporated herein in its entirety.

STATEMENT REGARDING FEDERALLY SPONSORED RESEARCH

None.

FIELD OF THE INVENTION

This invention relates to the process of setting cement plug in a well, for open hole or cased part of a well.

BACKGROUND OF THE INVENTION

For a variety of reasons, it is sometimes necessary to set a plug in an oil or gas well or water injector well.

Where a well has a casing in place with an annular space behind it, it is necessary in order to abandon the well to fill that space with cement, either by first milling away the casing or in a so-called perf, wash, cement ("P/W/C") operation.

It can also be necessary to set a cement plug in an un-cased or open hole region of a well, or in a region where there is a casing and outer annulus but there is already adequate cement in the annulus, bonded to the casing. Such a cement plug may need to be set in an abandonment operation or, more commonly, if a well needs to be diverted or branched laterally in which case the cement plug is needed to help divert the drill string/work string (a "kick-off plug"). There may be other reasons to set a base or fundament for a downhole operation.

This kind of plug is commonly referred to as a balanced plug and is named from its setting technique where the high density cement will u-tube between the work string bore and the annulus between work string and open hole/casing and come to equilibrium.

A balanced plug is set by running drill string into the well to the location where the plug is desired, and then passing cement down the string. Cement will, gradually, free fall down the drill pipe. As cement it delivered, it passes back along the annular space around the drill string. The volume of cement is calculated in advance so that a plug of the desired length is formed, and that the columns of cement in the drill string and in the annulus around it have approximately the same length and the same starting and finishing positions.

The gravitational and buoyancy forces acting on the cement and tending to cause it to form concentric columns of equal height in drill string and annulus (an effect referred to as U-tube effect) is largely determined, in terms of its intensity, by the density difference between the cement and existing fluid in the well (drilling fluid/mud), and also by the angle of the well or of the section of the well in which the plug is to be formed. Resistance to flow is largely given by cement and drilling fluid viscosity. U tube intensity and resistance to flow can both substantially affect the degree to which distinct cement columns are formed in the drill string and annulus, and the extent to which these columns may be mixed with the drilling fluid.

Cement may be preceded and followed by another fluid, e.g. spacer fluid. The spacer fluid is there to water wet the area of interest and or to separate the cement from the active drilling fluid to avoid chemical interference.

Once the correct volume of spacer and drilling fluid has been delivered to displace the cement in place, the drill string is withdrawn In practice, there is normally a degree of mixing of liquid cement with the existing well fluid or the spacer fluid. This can lead to the solidified cement plug having insufficient strength or impermeability or having voids or channels in it.

The present invention concerns a technique developed by the inventors whereby the cement is jetted into the well through a cementing tool on the end of the drill string. The cement is delivered as the drill string is both rotated and withdrawn. This technique is designed to give the cement more energy in order more effectively to displace the existing fluid in the well. This concept requires full control of the u-tube effect to avoid the cement floating in place when not pumped. To control that, a spring-loaded float valve is incorporated into the tool or at some point in the drill string above the tool. This is a pressure-activated valve which requires a pressure larger than the u-tube pressure from cement above the valve to open, allowing flow from the drill string to the annulus. There could also be a standard float valve in the assembly which has the same role, as the U-tube effect comes from annulus towards pipe in the end of the operation as all the cement is displaced from pipe to annulus.

The inventors have done a considerable amount of work understanding the behavior of cement jets downhole. Most of this work has been in connection with P/W/C cementing operations. See, for example, prior patent application US2020/040707A1 and Ferg, T., et al "Novel Techniques to More Effective Plug and Abandonment Cementing Techniques", *Society of Petroleum Engineers Artic and Extreme Environments Conference, Moscow,* 18-20 Oct. 2011 (SPE #148640). The contents of these publications are incorporated herein by reference.

The current understanding about the jet technique for P/W/C is accurately described in two manuscripts submitted to the Society of Petroleum Engineers (SPE) for publication in November 2020, numbered SPE-202397-MS and SPE-202441-MS. The contents of these papers are incorporated herein by reference.

Although the process is referred to as "cementing" and the plugging material as "cement", it is understood that it is not necessarily limited to the use of cement as such, and any suitable plugging material could be employed; the terms "cement" and "cementing" should be understood accordingly.

BRIEF SUMMARY OF THE DISCLOSURE

The inventors have performed a considerable amount of computational fluid dynamics (CFD) work regarding jetting of cement downhole and the geometry of a jetting tool including the outer diameter of the tool or parts of it relative to the inner diameter or drift diameter of casing. Most of this work has been done in the context of P/W/C but a balanced plug situation has also been modelled. The conclusions of this CFD work on setting a balanced plug were that the displacement was insufficient in high angle scenarios where the cement needed to displace a high viscosity spacer/mud/intermix. This work is the subject of a public presentation at the 2019 Plug and Abandonment Seminar in Stavanger, Norway, on 17 Oct. 2019, entitled "Quality in Balance Plug Cementing Operations". The presentation can be accessed at https://norskoljeoggass.no/drift/presentasjonerarrangementer/plug--abandonment-seminar-2019/. The contents of this presentation are incorporated herein by reference.

The inventors have been led to design a jetting tool and bottom hole assembly tailored for the placing of a cement plug in a "pump, pull, rotate" operation.

In contrast to P/W/C, where the main challenge is to ensure that flow of sufficient energy passes through perforations in the casing, the challenge in setting a balanced plug is to fill the space occupied by the BHA with cement whilst minimizing mixing, and to withdraw the BHA without adversely affecting the body of cement.

The inventors believe that a cement jetting tool with a relatively narrow diameter in the region of the jets is desirable.

In a P/W/C job, it is desirable that the energy of a jet passing directly across a casing perforation as the tool rotates is delivered efficiently into the outer annulus. This is what the inventors call the "primary effect", which is maximized by maximizing the outer diameter of the cement tool. However, when setting a cement plug in open/cased hole with the PPR technique the nozzles, flow and rotation will create a "piston effect" which pushes the fluid being displaced. In the region of the nozzles it has been found through CFD analysis that the energy of the flow to displace existing fluid can be enhanced by providing a larger diameter "choke" proximally of the nozzles as it will extend the "piston effect" past the normal dampening length In modelling P/W/C operations, the inventors have investigated the energy of the flow in the inner annulus between tool and casing at different axial distances from the tool, which is the driver for cement to pass through perforations at some axial distance from the cement nozzle. In a P/W/C job, the inventors have found that this effect is also maximized by maximizing the outer diameter of the cement tool. The inventors believe that this effect may be exploited also in a cement plug setting operation. They believe that increasing the energy of the flow at some distance axially from the nozzles, where the energy of the flow would normally be diminished, will have a beneficial effect. This work provides an additional reason for having an increased diameter energy enhancing region proximal of the nozzles. The energy-enhancing region may have the additional effect of helping to centralize and/or stabilize the BHA and cement tool.

It is often necessary to set a cement plug or fundament in an open hole region distal of a cased region of well. The open hole region may be under-reamed and therefore of substantially larger diameter than the cased region of the well. This means that it may be desirable for the energy enhancing region of the tool to have a larger diameter than would be possible to fit through the cased region of the well. The inventors have conceived of having an expandable energy enhancing region, allowing the tool to be delivered through the casing in a non-deployed, narrow state and then deployed into an expanded diameter state once the open hole region in which the plug is to be set has been reached.

The expandable section of tool may comprise a cylindrical wall comprising a number of rigid elements, e.g. of steel, alternating with resiliently flexible elements, e.g. of elastomeric material, around the circumference. When cement is pumped through the tool, the pressure of the cement may then expand the resilient members and therefore the overall tool diameter. Alternatively, the structure may comprise resilient material around the entire circumference, optionally with rigid reinforcing members e.g. of steel embedded in it in similar to a car tyre.

The use of a jetting tool, as opposed simply to passing cement through an open end of drill string, allows for the distal end of the tool to be designed to minimize negative effects on the cement due to withdrawal of the tool (swab effect). The inventors believe that a tapered distal end will minimize disruption of the un-set body of cement and mixing with the original well fluid.

According to the invention, a cementing tool and method of setting a cement plug are provided as set out in the claims appended to this specification.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
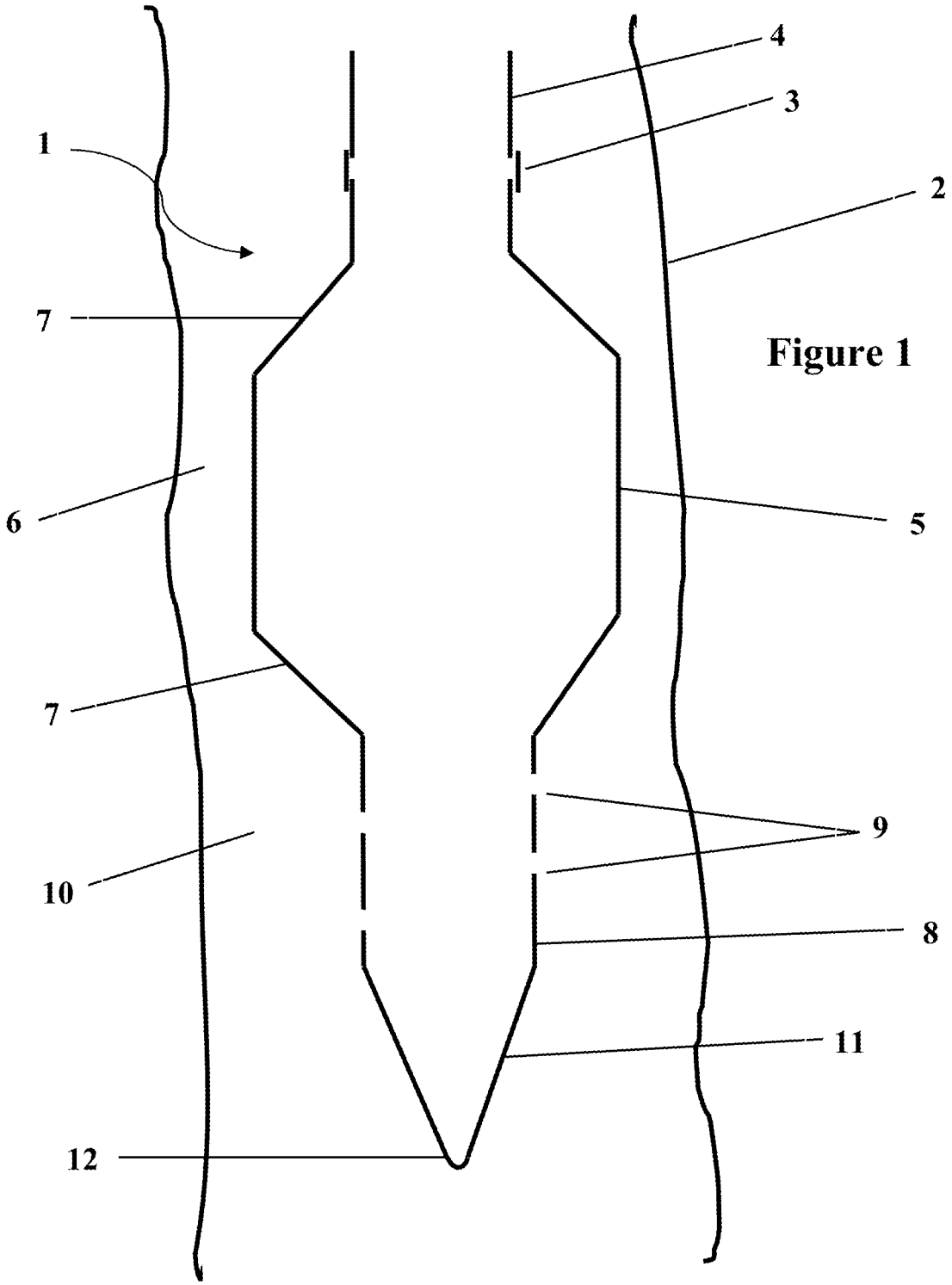
FIG. 1 is a schematic side view of a first embodiment of cementing BHA in accordance with the invention.

Referring to FIG. 1, a hollow cementing tool 1 is located in an open hole wellbore 2, connected via a connector 3 to drill string or drill pipe 4. Below or distal of the connector 3 is an enlarged diameter choke region 5, leaving a relatively narrow annular space 6 with the wellbore 2. The tool 1 may not be completely central in the wellbore 2 and the choke region may, in fact, rest on one side of the well bore 2. At each end of the choke region 5 are tapers 7 which are designed to help smooth running in and pulling of the tool 1.

Below or distal of the choke region 5 is a narrower diameter nozzle region 8 in which cement nozzles 9 are formed. The cement nozzles 9 are essentially apertures in the cylindrical wall of the tool, which may include an insert of hard wearing alloy (not shown) to prevent undue wear by the passage of high pressure cement though the nozzle 9. The space 10 between the nozzle region and well bore 2 is relatively large and is maintained around the full circumference of the tool even when the tool is not central, since the larger diameter choke region 5 will support the tool against the well bore 2.

Distal of the nozzle region is a tapered region 11 terminating in a closed end 12 with a small radius.

In use, the tool 1 is run into the well 2 to a location where it is desired to set a cement plug. The well bore 2 shown in FIG. 1 is open hole but it is equally possible to perform the procedure to set a plug in the interior of casing. At this point cement is delivered, optionally preceded by spacer fluid, by jetting it through the nozzles 9. By jetting the cement, the existing fluid in the wellbore is effectively displaced by the high energy cement which fills the space 10 between the nozzle region 8 of the tool and the wellbore 2. All or most of the existing fluid will be displaced upwardly As cement is delivered the tool is rotated to help to distribute energized cement evenly around the well bore. The tool is also withdrawn, i.e. moved upwardly/proximally in FIG. 1, during delivery of cement. The tapered end region 11 helps to prevent undue disturbance of the placed cement by suction as the tool is withdrawn.

The choke region 5 has the effect of partially obstructing the upward cement flow which increases the pressure and energy of the cement in the spaces 6 and 10 around the tool 1. The choke region 5 could be considered to act as a "choke" to assist the build-up of pressure.

Figure 2:
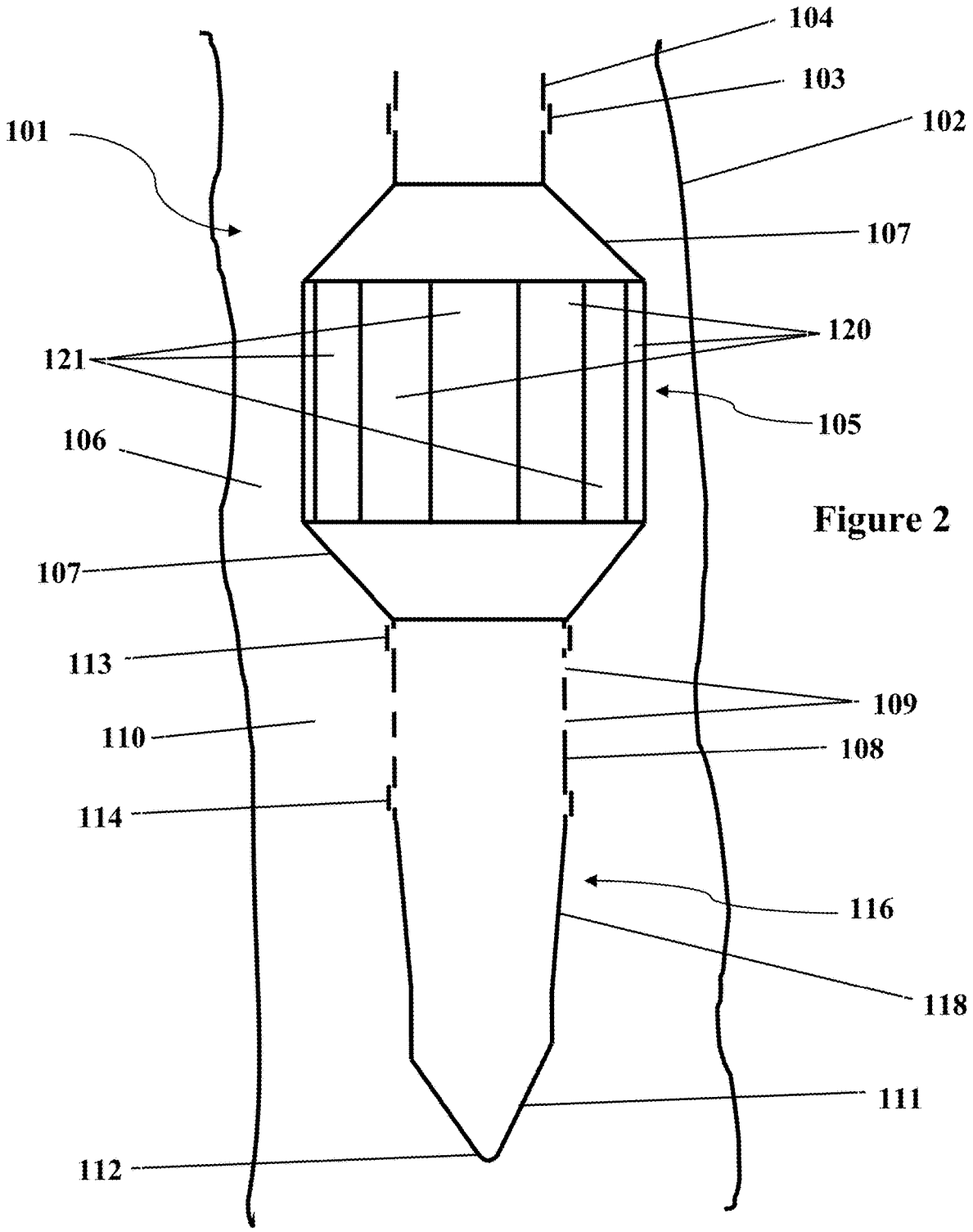
FIG. 2 is a view similar to FIG. 1 of a second embodiment of cementing BHA.

FIG. 2 shows a cementing bottom hole assembly 101 in a well bore 102. The assembly 101 includes an expandable choke module 105 connected by a proximal connector 103 to drill string 104. The choke module 105 includes tapered shoulders 107 at its distal and proximal ends. A space 106 is defined between the choke module 105 and the well bore 102. At the distal end of the module 105 is a connector 113 for connecting to a nozzle module 108.

The tapered shoulders 107 of the choke module 105 are made from elastomeric material. The cylindrical part of the choke module between the tapers 107 comprises alternating elastomeric panels 120 and steel panels 121.

Connected to the distal connector 113 of the choke module 105 is a relatively small diameter, generally cylindrical nozzle module 108 with a number of cement jetting nozzles 109 formed in it. The nozzle module 108 defines an annular space 110 between it and the well bore 102. At the distal end of the nozzle module is a connector 114.

Connected to the connector 114 is a tapered module 116, performing the same function as the taper 11 on the cementing tool of the first embodiment, and terminating in a closed end 112 with a small radius.

The tapered module 116 comprises first and second tapering surfaces 118, 111 to achieve an overall taper over the length of the module 116. In a modification, the overall taper may be achieved in steps.

The functioning of the second embodiment is in most ways the same as that of the first. The assembly is run into the well bore in the same way and cement injected as the assembly is rotated and withdrawn. However, when the second embodiment is run into the hole, the elastomeric elements 120 will be in a relaxed state since the pressure within the work string is relatively low. In this state, the overall diameter of the choke module 105 is relatively small, allowing it to be passed through casing.

Once the assembly 101 has reached the chosen site for a plug to be set, in an underreamed open hole part of the well, cement is delivered under pressure. The pressure of the cement causes the elastomeric elements 120 and the tapers 107 to stretch and thus the overall diameter of the choke module 105 to increase.

Figure 3:
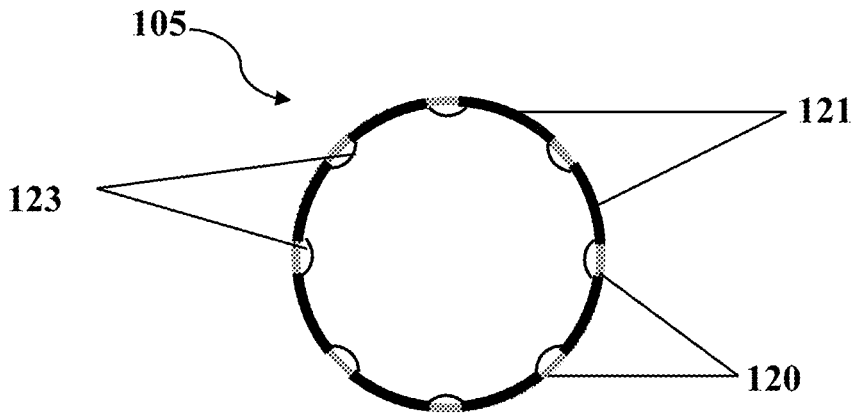
FIG. 3 is a schematic transverse section through a choke module of the second embodiment, in an un-expanded state.

It is important that the maximum diameter of the choke module does not increase to the extent that it blocks the well. For this reason, expansion-limiting steel cables are provided internally. Referring to FIG. 3, the choke module is shown in transverse section in its un-expanded state. Steel elements 121 alternate with elastomeric elements 120 around the circumference and flexible steel cables 123 connect the steel elements 121. The cables 123 are slack as shown in FIG. 3.

Figure 4:
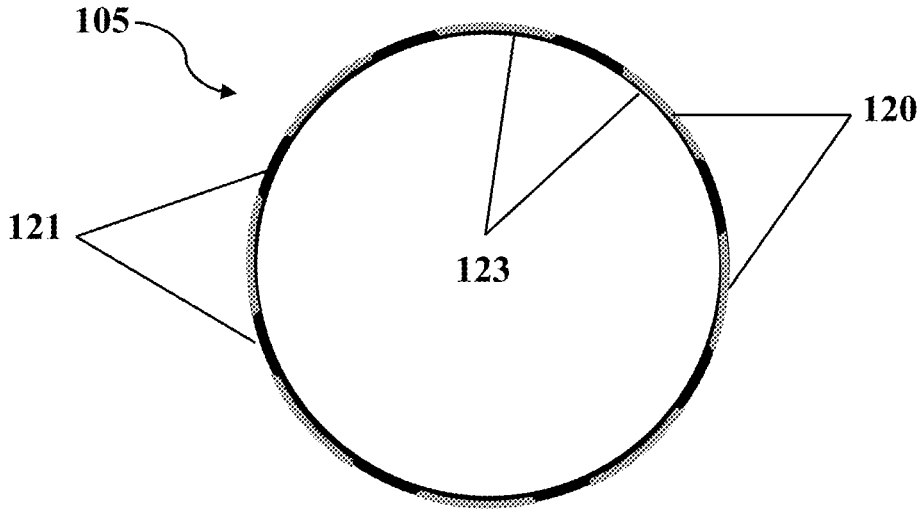
FIG. 4 is a view similar to FIG. 3, showing the choke module in an expanded state.

FIG. 4 shows the state of the choke module 105 when pressurized by cement. The overall diameter of the module 105 is increased. The elastomeric elements 120 are stretched and the cables 123 between the steel elements 121 are taut, thereby restricting further expansion.

It will be understood by the skilled reader that the second embodiment, or parts of it, could be provided as a unitary cementing tool. In the same way, the first embodiment could be provided as an assembly of components.

The first and second embodiments could be used in open hole sections of well with different average inner diameters. A 14 inch average inner diameter is representative, but larger or smaller open holes could be cemented using this technique. Similarly, any size of cased wellbore could be cemented.

Based on CFD work for P/W/C operations, it is believed that the maximum outer diameter of the choke region or regions should be between 0.1 and 3 inch smaller than the average open hole diameter or, for casing, the casing drift diameter. Ideally, the difference in diameter is from 0.3 to 2 inch, most preferably from 0.5 to 1 inch. The maximum outer diameter of the nozzle region of the tool should be between 2 and 5 inches smaller than the average open hole diameter or, for casing, the casing drift diameter. Ideally, the difference in diameter is from 3 to 4 inch.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

Ferg, T., et al "Novel Techniques to More Effective Plug and Abandonment Cementing Techniques", *Society of Petroleum Engineers Artic and Extreme Environments Conference, Moscow,* 18-20 Oct. 2011 (SPE #148640).

US2020/040707A1 (ConocoPhillips)

The invention claimed is:

1. A cementing tool for delivering into a hydrocarbon production or water injection well to create a cement plug at a location in the well, wherein the well has an average inner diameter at the location for setting the plug, and wherein the tool comprises a generally cylindrical hollow body comprising:

a. a nozzle portion with one or more nozzles formed in it;

b. a tapered portion distal of the nozzle portion and terminating in a closed end of smaller diameter than the nozzle portion;

c. a choke portion having a maximum outer diameter larger than that of the nozzle portion and located proximally of the nozzle portion, wherein the choke portion comprises tapers at its proximal and distal ends; and d. at the proximal end of the tool a connector for connecting to a drill string, wherein the choke portion is expandable such that the maximum diameter of the choke portion is achieved when the portion is in an expanded state in which state further expansion is restricted and in which state the well is not blocked by the choke portion.

2. The cementing tool according to claim 1, wherein the nozzle portion has a maximum outer diameter that is at least 3 inches smaller than the inner diameter of the well.

3. The cementing tool according to claim 1, wherein the nozzle portion has a maximum outer diameter that is selected from about 0.5, 1, 1.5, 2, 2.5, 3, 3,5, 4, 4.5, 5, 5.5, 6, 6.5 and 7 inches smaller than the inner diameter of the well.

4. The cementing tool according to claim 1, wherein the tapered portion has a length between 12 and 48 inches.

5. The cementing tool according to claim 1, wherein the tapered portion has a maximum outer diameter at its distal end less than 10% of the maximum outer diameter of the nozzle portion.

6. The cementing tool according to claim 5, wherein the tapered portion has a radiused distal tip.

7. The cementing tool according to claim 1, wherein the tapered portion tapers substantially continuously or in steps.

8. The cementing tool according to claim 7, wherein the maximum outer diameter of the choke portion is between 0.1 and 3 inches less than the inner diameter of the part of the well where the plug is to be set.

9. The cementing tool according to claim 7, wherein the maximum outer diameter of the choke portion is between 0.3 and 2 inch less than the inner diameter of the part of the well where the plug is to be set.

10. The cementing tool according to claim 7, wherein the maximum outer diameter of the choke portion is between 0.5 and 1 inch less than the inner diameter of the part of the well where the plug is to be set.

11. The cementing tool according to claim 7 wherein the choke portion has a length between 24 and 48 inches.

12. The cementing tool according to claim 1 wherein the choke portion is expandable between a first, reduced diameter whilst being run into hole and the maximum diameter when pressurized cement is being delivered through it.

13. The cementing tool according to claim 1 wherein the choke portion comprises rigid elements alternating around its circumference with resiliently flexible elements.

14. The cementing tool according to claim 13 wherein the maximum diameter of the choke portion is set by flexible substantially inextensible elements extending between the rigid elements.

15. The cementing tool according to claim 1 wherein two or more of the nozzle portion, choke portion and tapered portion are separate bodies releasably connected together to form a bottom hole assembly.

16. A method of setting a cement plug in a hydrocarbon production or water injection well wherein the well has an average inner diameter at the location for setting the plug, the method comprising:

(a) delivering to an intended location for setting the plug a cementing tool comprising a generally cylindrical hollow body comprising:

a. a nozzle portion with one or more nozzles formed in it;

b. a tapered portion distal of the nozzle portion and terminating in a closed end of smaller diameter than the nozzle portion;

c. a choke portion having a maximum outer diameter larger than that of the nozzle portion and located proximally of the nozzle portion, wherein the choke portion comprises tapers at its proximal and distal ends, wherein the choke portion is expandable such that the maximum diameter of the choke portion is achieved when the portion is in an expanded state in which state further expansion is restricted and in which state the well is not blocked by the choke portion; and d. at the proximal end of the tool a connector for connecting to a drill string;

(b) passing cement into the well whilst rotating and withdrawing the tool.

* * * * *